US008276253B2

(12) United States Patent
Herbold et al.

(10) Patent No.: US 8,276,253 B2
(45) Date of Patent: Oct. 2, 2012

(54) METHOD AND APPARATUS TO REMOVE OR INSTALL COMBUSTION LINERS

(75) Inventors: John W. Herbold, Fountain Inn, SC (US); Randall S. Corn, Travelers Rest, SC (US); James B. Holmes, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 659 days.

(21) Appl. No.: 12/477,451

(22) Filed: Jun. 3, 2009

(65) Prior Publication Data

US 2010/0307000 A1 Dec. 9, 2010

(51) Int. Cl.
*B21D 39/04* (2006.01)
*B23P 19/04* (2006.01)
*B25B 27/00* (2006.01)

(52) U.S. Cl. ..... 29/282; 29/256; 29/267; 29/271; 29/278

(58) Field of Classification Search ..... 29/256, 29/267, 271, 278, 280, 282, 428, 464, 888
See application file for complete search history.

(56) References Cited

U.S. PATENT DOCUMENTS

| | | | | |
|---|---|---|---|---|
| 4,074,411 | A * | 2/1978 | Willard et al. | 29/267 |
| 4,528,735 | A * | 7/1985 | Eastridge et al. | 29/221.5 |
| 5,274,991 | A | 1/1994 | Fitts | |
| 5,323,600 | A | 6/1994 | Munshi | |
| 6,279,313 | B1 | 8/2001 | Lawen, Jr. et al. | |
| 6,345,441 | B1 | 2/2002 | Farmer et al. | |
| 6,923,002 | B2 | 8/2005 | Crawley et al. | |
| 6,951,109 | B2 | 10/2005 | Lemon et al. | |
| 7,040,096 | B2 | 5/2006 | Manteiga et al. | |
| 7,086,232 | B2 | 8/2006 | Moertle et al. | |
| 7,093,440 | B2 | 8/2006 | Howell et al. | |
| 7,360,364 | B2 | 4/2008 | Danis et al. | |
| 7,493,767 | B2 | 2/2009 | Bunker et al. | |
| 7,836,569 | B2 * | 11/2010 | Spaulding et al. | 29/249 |

* cited by examiner

*Primary Examiner* — Alexander P Taousakis
(74) *Attorney, Agent, or Firm* — James W. Pemrick; Ernest G. Cusick; Frank A. Landgraff

(57) ABSTRACT

A method and apparatus for removing and installing combustion liners in a combustion case of a turbine is provided. The apparatus includes an elongated handle having a pin disposed at one end, and a bracket attached to the elongated handle. A tower clamp, for attaching to a flange of a combustion case, includes a tower portion having a plurality of notches for receiving the pin of the elongated handle.

8 Claims, 7 Drawing Sheets

METHOD AND APPARATUS TO REMOVE OR INSTALL COMBUSTION LINERS

BACKGROUND OF THE INVENTION

The subject matter disclosed herein relates to gas turbine engines and, more specifically, to a method and apparatus to remove and/or install combustion liners.

Gas turbine engines typically include a combustor having a combustor liner defining a combustion chamber. Within the combustion chamber, a mixture of compressed air and fuel is combusted to produce hot combustion gases. The combustion gases may flow through the combustion chamber to one or more turbine stages to generate power for driving a load and/or a compressor. Typically, the combustion process heats the combustor liner due to the hot combustion gases.

Combustion liners are routinely removed and installed during gas turbine maintenance activity. Some known removal tooling, on the most part, can be awkward but slowly helps remove combustion liners without significant damage. The combustion liner stops require circumferential alignment within each combustion chamber, typically between the male combustion liner stops and the female combustion liner stops. Hula seals usually require several hundred pounds of axial installation force, which is often applied with a manually operated hammer. Hammering force has variation, can damage parts, and can injure humans. Without proper liner stop alignment, the liner is rotated while the hula seal is under load. Torsional loading of the hula seal can damage the seal leafs or seal coating.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In one embodiment of the present invention, a method and apparatus for removing and installing combustion liners in a combustion case of a turbine is provided. The apparatus includes an elongated handle having a pin disposed at one end, and a bracket attached to the elongated handle. A tower clamp, for attaching to a flange of a combustion case, includes a tower portion having a plurality of notches for receiving the pin of the elongated handle.

In another embodiment of the present invention, a method of installing a combustion liner in a combustion case of a turbine is provided. The method includes the steps of providing an alignment guide for aligning a stop of the combustion liner with a stop on the combustion case. An attaching step attaches the alignment guide to the combustion case. An inserting step inserts the combustion liner at least partially into the combustion case. An elongated handle assembly, liner push rod and a tower clamp assembly are provided and the tower clamp assembly is attached to the combustion case. The liner push rod is attached to the elongated handle assembly, and the elongated handle assembly is attached to the tower clamp assembly. A groove in the liner push rod is positioned over a portion of the combustion liner, and the combustion liner is installed in the combustion case by applying force to the elongated handle assembly.

In yet another embodiment of the present invention, a method of removing a combustion liner in a combustion case of a turbine is provided. The method includes the steps of providing an elongated handle assembly, liner pull hook and a tower clamp assembly, attaching the tower clamp assembly to the combustion case, attaching the liner pull hook to the elongated handle assembly, and attaching the elongated handle assembly to the tower clamp assembly. The liner pull hook is positioned behind a stop of the combustion liner, and the combustion liner is at least partially removed from the combustion case by applying force to the elongated handle assembly.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
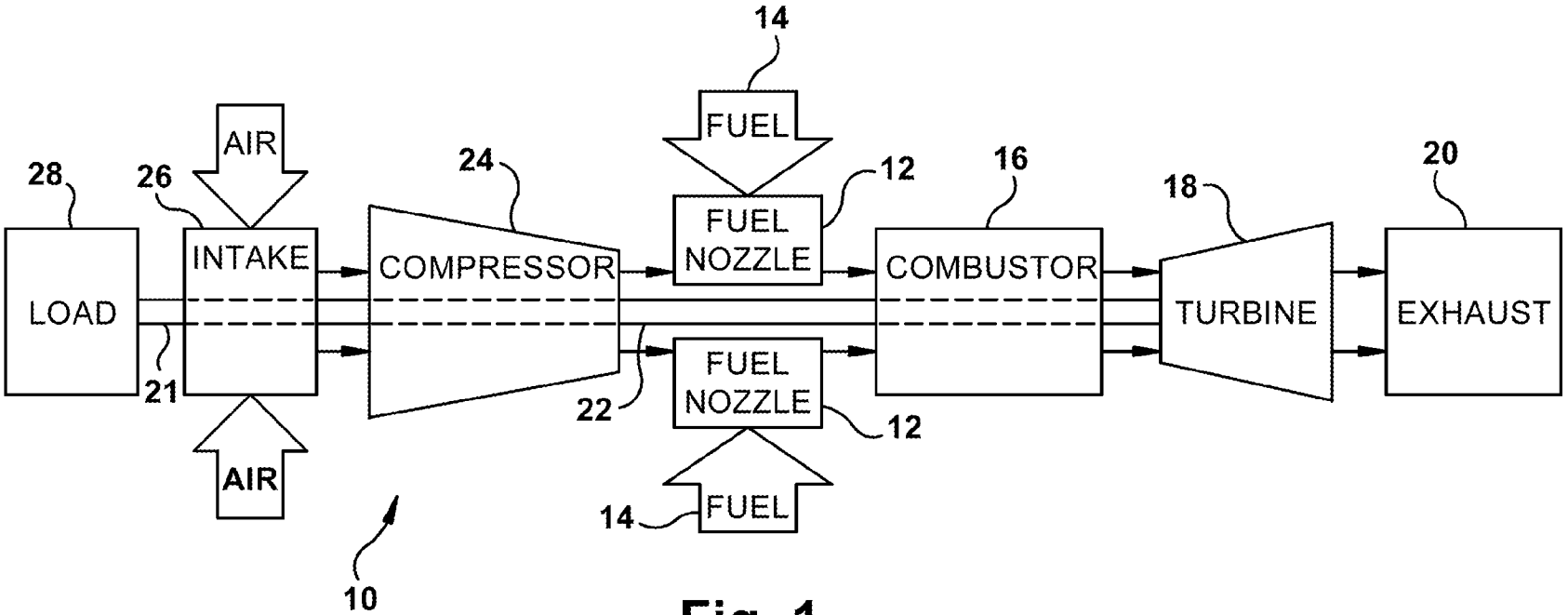
FIG. 1 is a block diagram illustration of a turbine system having a combustor liner.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment" or "an embodiment" of the present invention are not intended to be interpreted as excluding the existence of additional embodiments that also incorporate the recited features.

Before continuing, several terms used extensively throughout the present disclosure will be first defined in order to provide a better understanding of the claimed subject matter. As used herein, the terms "upstream" and "downstream," when discussed in conjunction with a combustor liner, shall be understood to mean the proximal end of the combustor liner and the distal end of the combustor liner, respectively, with respect to the fuel nozzles. That is, unless otherwise indicated, the terms "upstream" and "downstream" are generally used with respect to the flow of combustion gases inside the combustor liner. For example, a "downstream" direction refers to the direction in which a fuel-air mixture combusts and flows from the fuel nozzles towards a turbine, and an "upstream" direction refers to the direction opposite the downstream direction, as defined above. Additionally, the term "downstream end portion," "coupling portion," or the like, shall be understood to refer to an aft-most (downstream most) portion of the combustor liner. As will be discussed further below, the axial length of the downstream end portion of the combustor liner, in certain embodiments, may be as much as 20 percent the total axial length of the combustor liner. The downstream end portion (or coupling portion), in some embodiments, may also be understood to be the portion of the liner that is configured to couple to a downstream transition piece of the combustor, generally in a telescoping, concentric, or coaxial overlapping annular relationship. Further, where the term "liner" appears alone, it should be understood that this term is generally synonymous with "combustor liner" or "combustion liner". Keeping in mind the above-defined terms, the present disclosure is directed towards a method and apparatus to remove and/or install a combustion liner of a turbine engine.

Turning now to the drawings and referring first to FIG. 1, a block diagram of an embodiment of a turbine system 10 is illustrated. As discussed in detail below, the disclosed turbine system 10 may employ a combustion liner having a plurality of surface features formed about a downstream end portion to provide for improved and more uniform cooling of the liner. The turbine system 10 may use liquid or gas fuel, such as natural gas and/or a hydrogen rich synthetic gas, to run the turbine system 10. As depicted, a plurality of fuel nozzles 12 intakes a fuel supply 14, mixes the fuel with air, and distributes the air-fuel mixture into a combustor 16. The air-fuel mixture combusts in a chamber within combustor 16, thereby creating hot pressurized exhaust gases. The combustor 16 directs the exhaust gases through a turbine 18 toward an exhaust outlet 20. As the exhaust gases pass through the turbine 18, the gases force one or more turbine blades to rotate a shaft 22 along an axis of system 10. As illustrated, the shaft 22 is connected to various components of turbine system 10, including a compressor 24. The compressor 24 also includes blades that may be coupled to shaft 22. Thus, blades within compressor 24 rotate as shaft 22 rotates, thereby compressing air from an air intake 26 through compressor 24 and into fuel nozzles 12 and/or combustor 16. The shaft 21 may be connected to a load 28, which may be a vehicle or a stationary load, such as an electrical generator in a power plant or a propeller on an aircraft. As will be understood, the load 28 may include any suitable device that is capable of being powered by the rotational output of turbine system 10. The load 28 may also be taken on the turbine end of the gas turbine.

Figure 2:
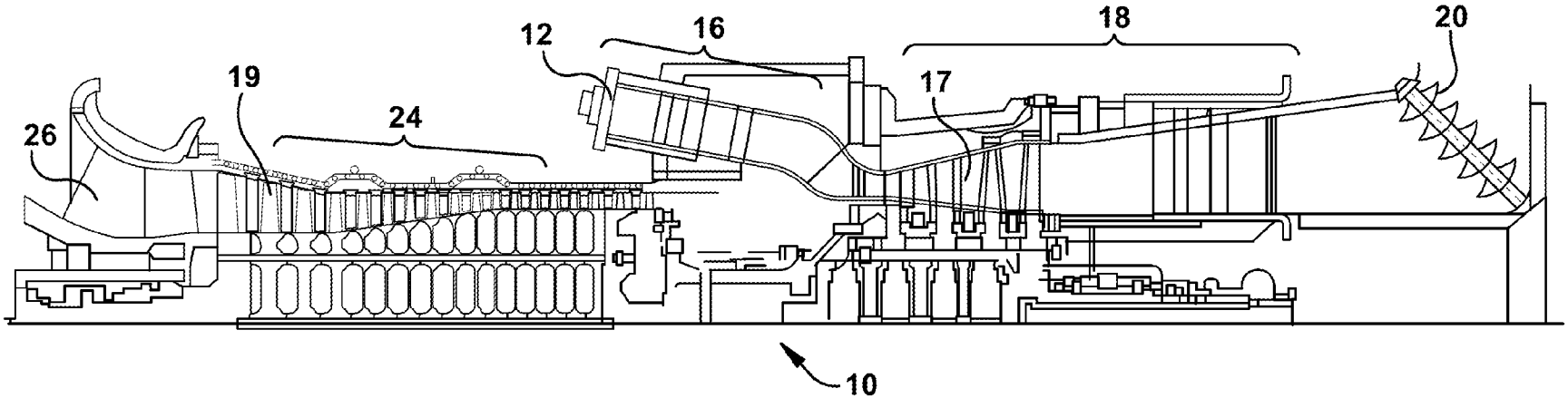
FIG. 2 is a cutaway side illustration of the turbine system, as shown in FIG. 1.

FIG. 2 illustrates a cutaway side view of an embodiment of the turbine system 10 schematically depicted in FIG. 1. The turbine system 10 includes one or more fuel nozzles 12 located inside one or more combustors 16. The combustors 16 may include one or more combustion liners typically disposed within one or more respective flow sleeves. In operation, air enters the turbine system 10 through the air intake 26 and may be pressurized in the compressor 24. The compressed air may then be mixed with gas for combustion within combustor 16. For example, the fuel nozzles 12 may inject a fuel-air mixture into the combustor 16 in a suitable ratio for optimal combustion, emissions, fuel consumption, and power output. The combustion generates hot pressurized exhaust gases, which then drive one or more blades 17 within the turbine 18 to rotate the shaft 22 (shown in FIG. 1) and, thus, the compressor 24 and the load 28 (shown in FIG. 1). The rotation of the turbine blades 17 causes rotation of shaft 22, thereby causing the blades 19 within the compressor 22 to draw in and pressurize the air received by the intake 26. As the portion of the compressor-supplied air (which is generally substantially cooler relative to the combustion gases within the combustor 16) flows through the cooling channel and contacts the surface features, heat transfer occurs in which heat is removed from the combustor liner. By way of example, this heat transfer may occur via forced convection.

Figure 3:
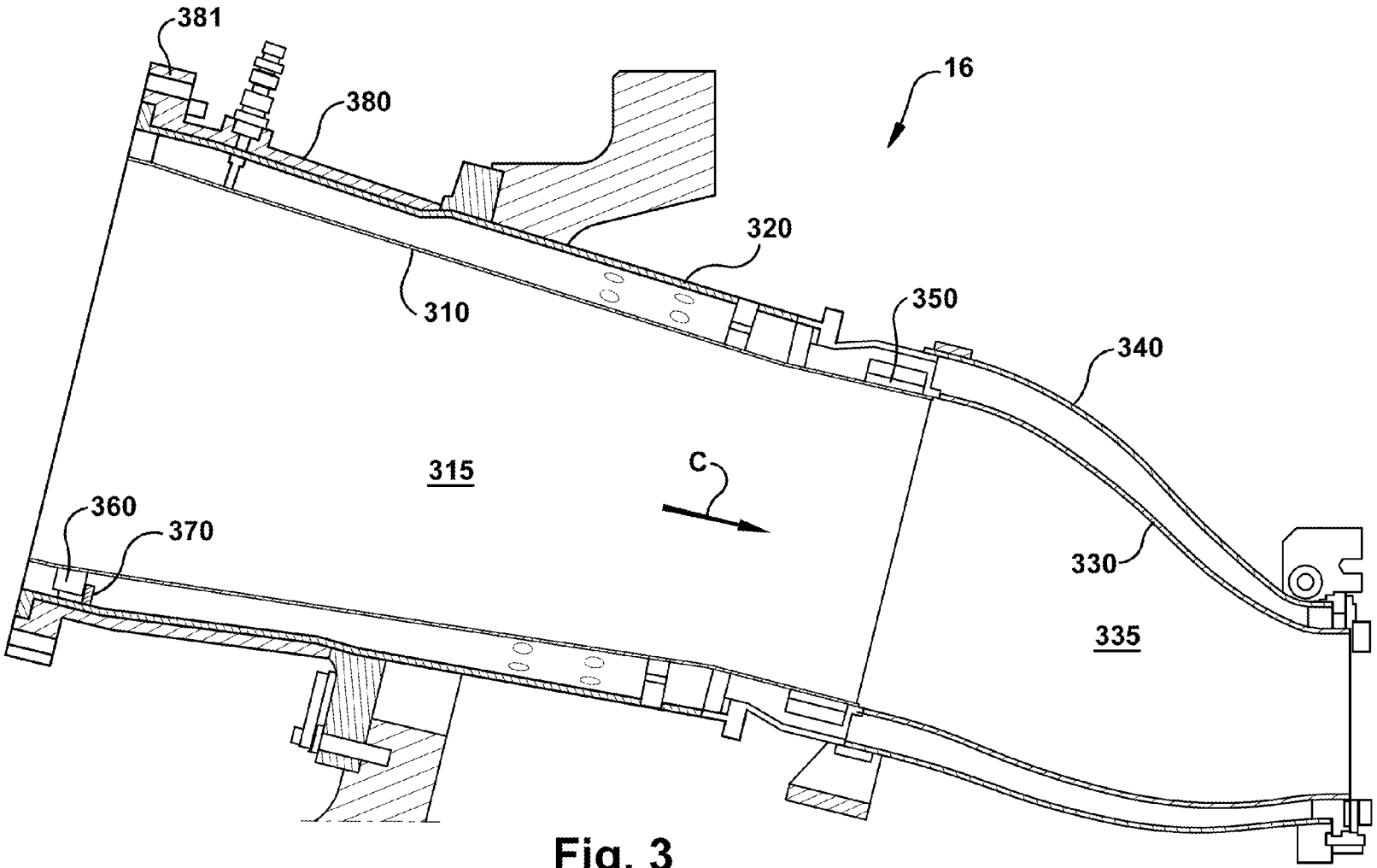
FIG. 3 is a cutaway side illustration of the combustor having a combustion liner, in accordance with an embodiment of the present invention.

Continuing now to FIG. 3, a more detailed cutaway side view of an embodiment of the combustor 16 is illustrated. As will be appreciated, the combustor 16 is generally fluidly coupled to the compressor 24 and the turbine 18. The combustor 16 includes a combustion liner 310 disposed within a flow sleeve 320. Flow sleeves may be used in conjunction with combustion liners, but some applications may omit the flow sleeve. The interior of the liner 310 may define a substantially cylindrical or annular combustion chamber 315. The combustion liner 310 illustrated is only one example of many variations of combustion liners that may be used with the method and apparatus of the present invention.

Downstream from the liner 310 and the flow sleeve 320 (e.g. in the direction C), a transition piece 330 may be coupled to the liner 310. Thus, the direction C may represent a downstream direction with respect to the flow of combustion gases away from the fuel nozzles 12 inside the liner 310. As used herein, the terms "upstream" and "downstream," when discussed in conjunction with a combustion liner, shall be understood to mean the proximal end of the combustor liner and the distal end of the combustor liner, respectively, with respect to the fuel nozzles. That is, unless otherwise indicated, the terms "upstream" and "downstream" are generally used with respect to the flow of combustion gases inside the combustor liner. For example, a "downstream" direction refers to the direction in which a fuel-air mixture combusts and flows from the fuel nozzles towards a turbine, and an "upstream" direction refers to the direction opposite the downstream direction, as defined above.

The transition piece 330 (which may also be referred to as a "transition duct") may be disposed within an impingement sleeve 340. An interior cavity 335 of the transition piece 330 generally provides a flow path (as shown by the arrow C) by which combustion gases from the combustion chamber 315 may be directed to the turbine 18. In the depicted embodiment, the transition piece 330 may be coupled to the downstream end of the liner 310 (in the direction C) with a seal 350 (e.g., a hula seal). In some combustion liner embodiments, a hula seal may seal the junction between the combustion liner and the transition piece. Hula seals are circumferential metal seals that may be slotted in the axial direction and contoured to be spring loaded between an inner and outer diameter of mating parts that experience relative motion. Hula seals can be located between the combustion liner aft (i.e. downstream) end and the transition piece forward end (i.e. upstream).

The combustion liner 310 incorporates one or more male liner stops 360 that engages one or more female liner stops 370 attached to flow sleeve 320. In some embodiments without a flow sleeve, the stops may be attached to the interior of combustion case 380. The combustion case 380 typically also includes a flange 381. The female liner stop 370 is generally "U"-shaped and the male liner stop 360 is generally rectangular in cross-section and fits within female liner stop 370. The liner stops require circumferential alignment within each combustion chamber, typically between the male combustion liner stops 360 and the female combustion liner stops 370. The liner stops aid in installation/removal of the liner 310, and prevent the liner 310 from rotating during operation of turbine 10.

Hula seal 350 seals the downstream end of combustion liner 310 to the upstream end of transition piece 330. Hula seals usually require several hundred pounds of axial installation force, which in the past has typically been applied with a hammer. Hammering force has variation, can damage parts, and can injure humans. Without proper liner stop alignment, the liner can be rotated while the hula seal is under load within the transition piece inlet diameter. Torsional loading of the hula seal can damage the seal leafs or seal coating.

A combustion liner installation and removal tool 400, according to an aspect of the present invention, will now be described in conjunction with FIG. 4. A handle 410 can incorporate a rubberized grip 420 at a first end, and a U-shaped bracket 430 at an opposing end. The handle 410 can be used to push a liner 310 into the combustion chamber, or it may be used to pull a liner 310 out of the combustion chamber, as will be described more fully hereinafter. The bracket 430 has a hole disposed near the end that permits the passage of a pin 435. The pin 435 may also incorporate one or more through holes at each end to accept a suitable fastening means (e.g., cotter pin, spring-type cotter pin, or any other suitable fastener). The pin fits into one of a plurality of notches in a clamp tower 440. The multiple notches allow a user to position the handle at various heights for optimal leverage. The tower clamp 490 has a U-shaped base 445 that uses an adjustable clamp screw 447 and knob 449 to securely attach the tower clamp 490 to a flange of a combustion chamber. The handle also incorporates a bracket 412 having a through hole 414 for the attachment of various parts to aid in the installation and removal of combustion liners. The handle assembly (410, 412, 420, 430, 435) and tower clamp assembly (440, 445, 447, 449) could be manufactured from any material that withstands induced stress during tool use, typically but not limited to steel, steel alloys, aluminum, aluminum alloys, combinations thereof or any other suitable material.

Figure 5:
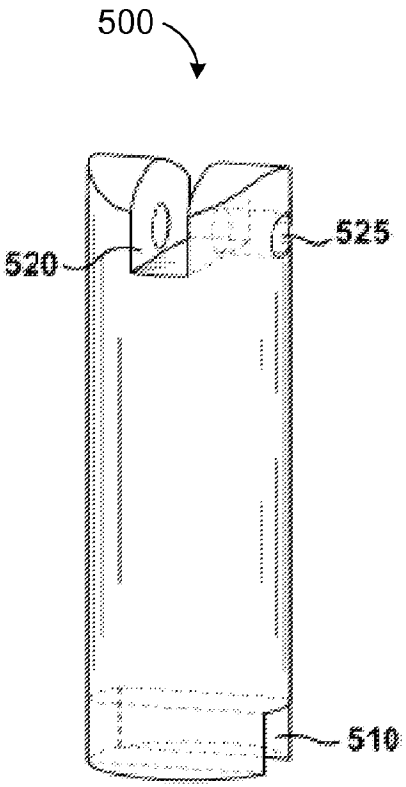
FIG. 5 is a perspective illustration of a liner push rod that can be used to install combustion liners, in accordance with an embodiment of the present invention.

FIG. 5 illustrates a perspective view of a liner push rod 500, which may be used with handle 410 to push a combustion liner 310 into position during installation. The liner push rod 500 is generally in the shape of a cylinder and has a bottom slot 510. The bottom slot 510 is sized to fit over a portion of liner 310. A top slot 520 is arranged orthogonally to bottom slot 510, and contains a through hole 525. The through hole 525 is placed in alignment with through hole 414 of bracket 412. A suitable fastening means (e.g., a pin and cotter pin) can be used to fasten push rod 510 to bracket 412. The liner push rod 500, once connected to bracket 412, can pivot about an axis co-linear with the pin used to pass through holes 414 and 525. The liner push rod 500 could be manufactured from any material that withstands induced stress during tool use, typically but not limited to steel, steel alloys, aluminum, aluminum alloys, combinations thereof or any other suitable material.

Figure 6:
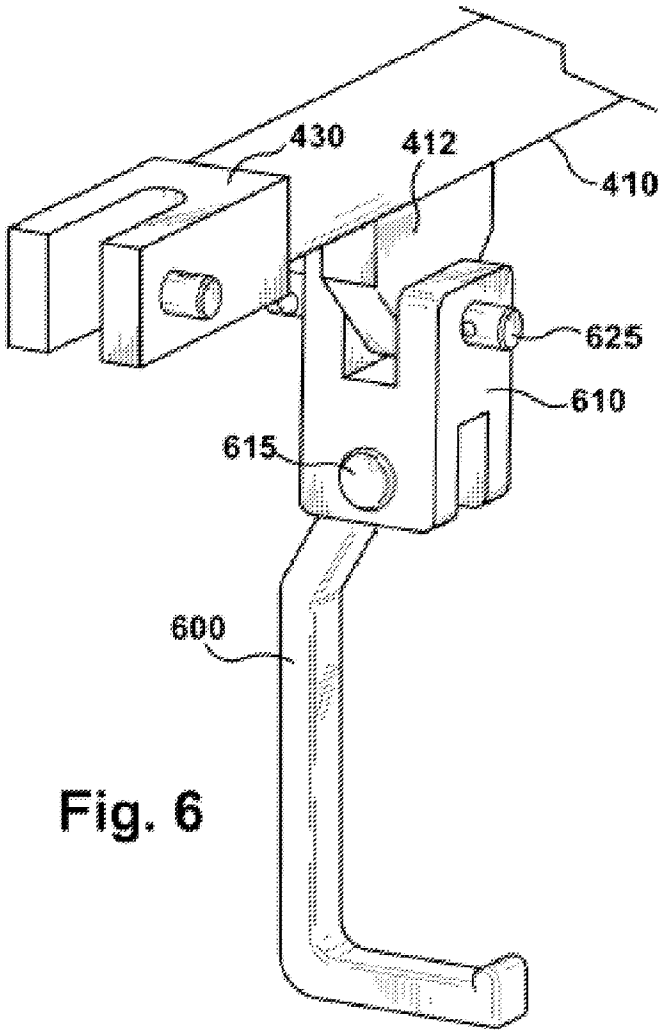
FIG. 6 is a perspective illustration of a liner pull hook that can be used to remove combustion liners, in accordance with an embodiment of the present invention.

FIG. 6 illustrates a perspective view of a liner pull hook 600, which may be used with handle 410 to aid in pulling combustion liner 310 out during removal. The hook 600 is secured to a mounting block 610 via a pin 615. The block is secured to bracket 412 with pin 625. The hook can pivot about two axis defined by pins 615 and pin 625. The hook can be placed under a male liner stop 360 to aid in removal of the combustion liner 310. All the pins used with the various aspects of the present invention can be secured in place with cotter pins and/or an integral stop formed on one side of the pin, which stops the pin from passing through the hole. As will be understood, the pin and cotter pins, can be replaced with any other suitable fastening means, including but not limited to, spring-type cotter pins, bolts with nuts and/or washers, and circular cotter pins. The liner pull hook 600 and mounting block 610 could be manufactured from any material that withstands induced stress during tool use, typically but not limited to steel, steel alloys, aluminum, aluminum alloys, combinations thereof or any other suitable material.

Figure 7:
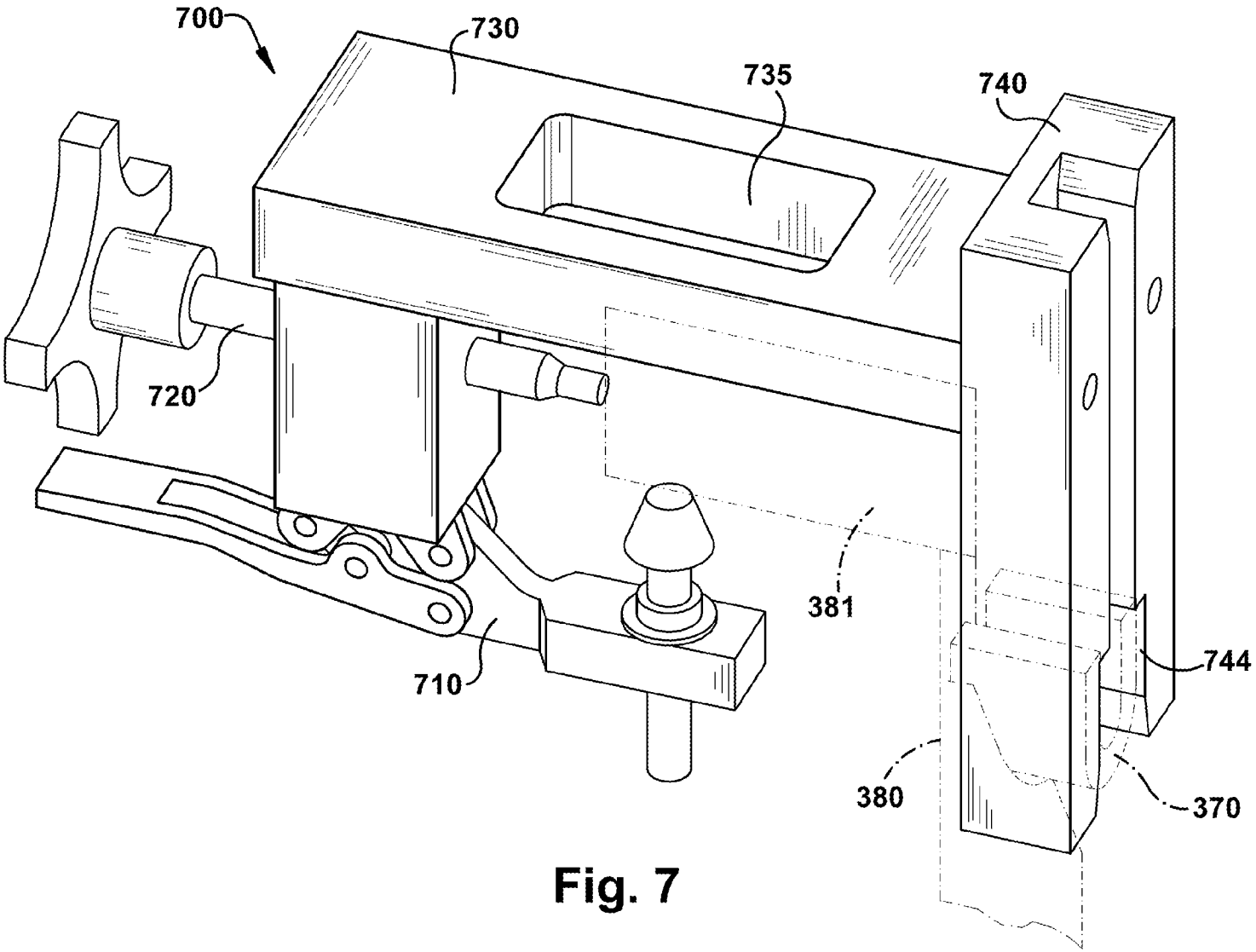
FIG. 7 is a perspective illustration of an alignment guide that can be used during the removal and installation of combustion liners, in accordance with an embodiment of the present invention.

FIG. 7 illustrates a perspective view of an alignment guide 700, according to an aspect of the present invention. The alignment guide 700 is clamped onto the flange 381 of the combustion case 380 and is used to guide the male liner stop 360 into female liner stop 370. The alignment guide includes a clamp mechanism 710 and adjustable screw 720 that secure the alignment guide to the flange 381. A top plate 730 can incorporate a window 735 that can be used to position the clamp over alignment marks on flange 381. A guide plate 740 includes a track 742 that is sized to accommodate at least a portion of the male liner stop 360. Tie male liner stop 360 slides along this track 742. The track 742 is flared at the top or entry point to facilitate insertion of the male liner stop 360. The bottom of the track 742 exits into cavity 744 that is sized to accommodate the female liner stop 370. In some applications the male and female stops can be swapped. That is, the male stop may be located on the combustion case and the female stop may be located on the combustion liner. In these applications the alignment guide would be designed accordingly. For example, the track 742 could be designed to accommodate and guide a female stop, and the cavity 744 could be designed to accommodate a male stop.

Figure 4:
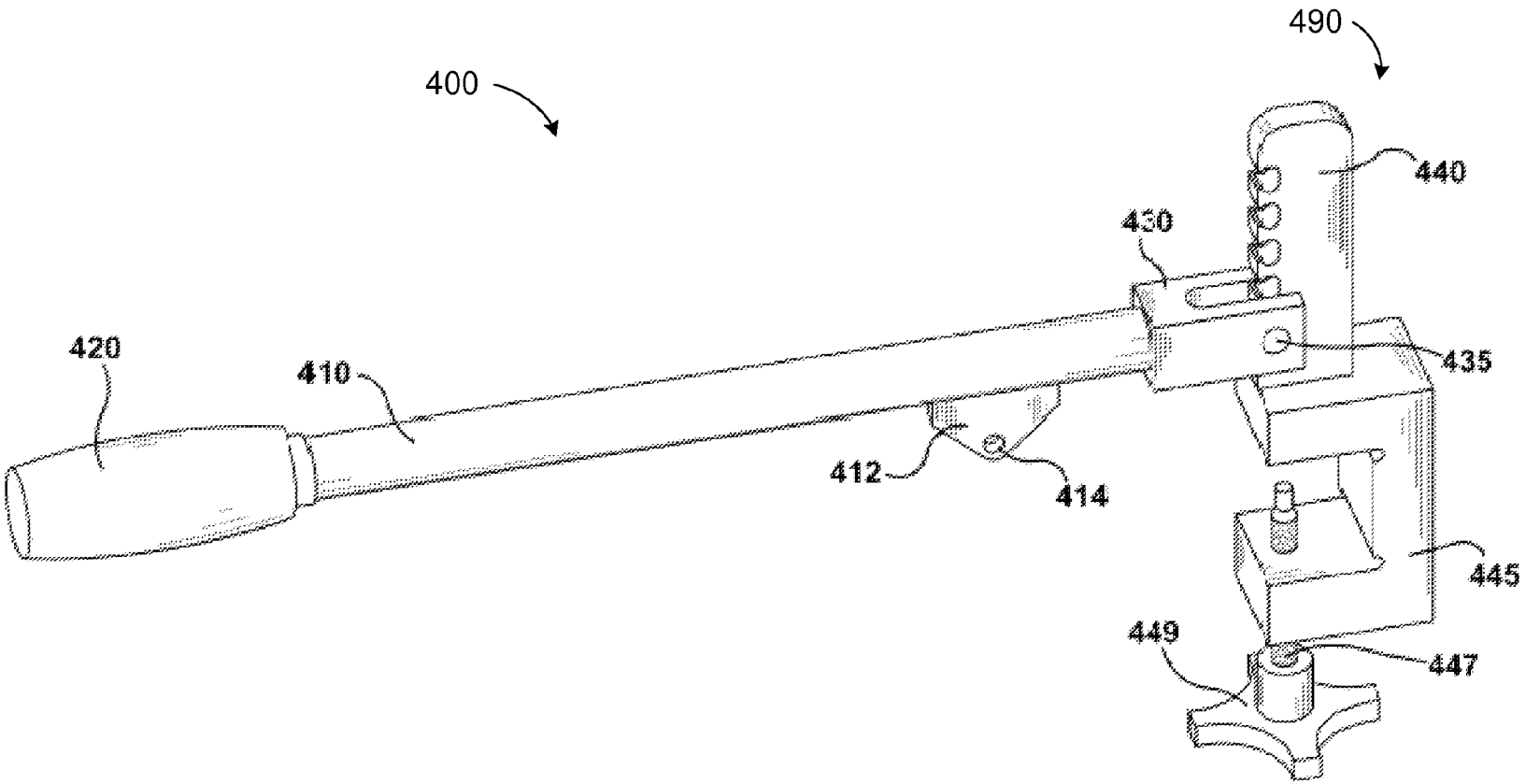
FIG. 4 is a perspective illustration of a handle and clamp that can be used to remove and install combustion liners, in accordance with an embodiment of the present invention.
Figure 8:
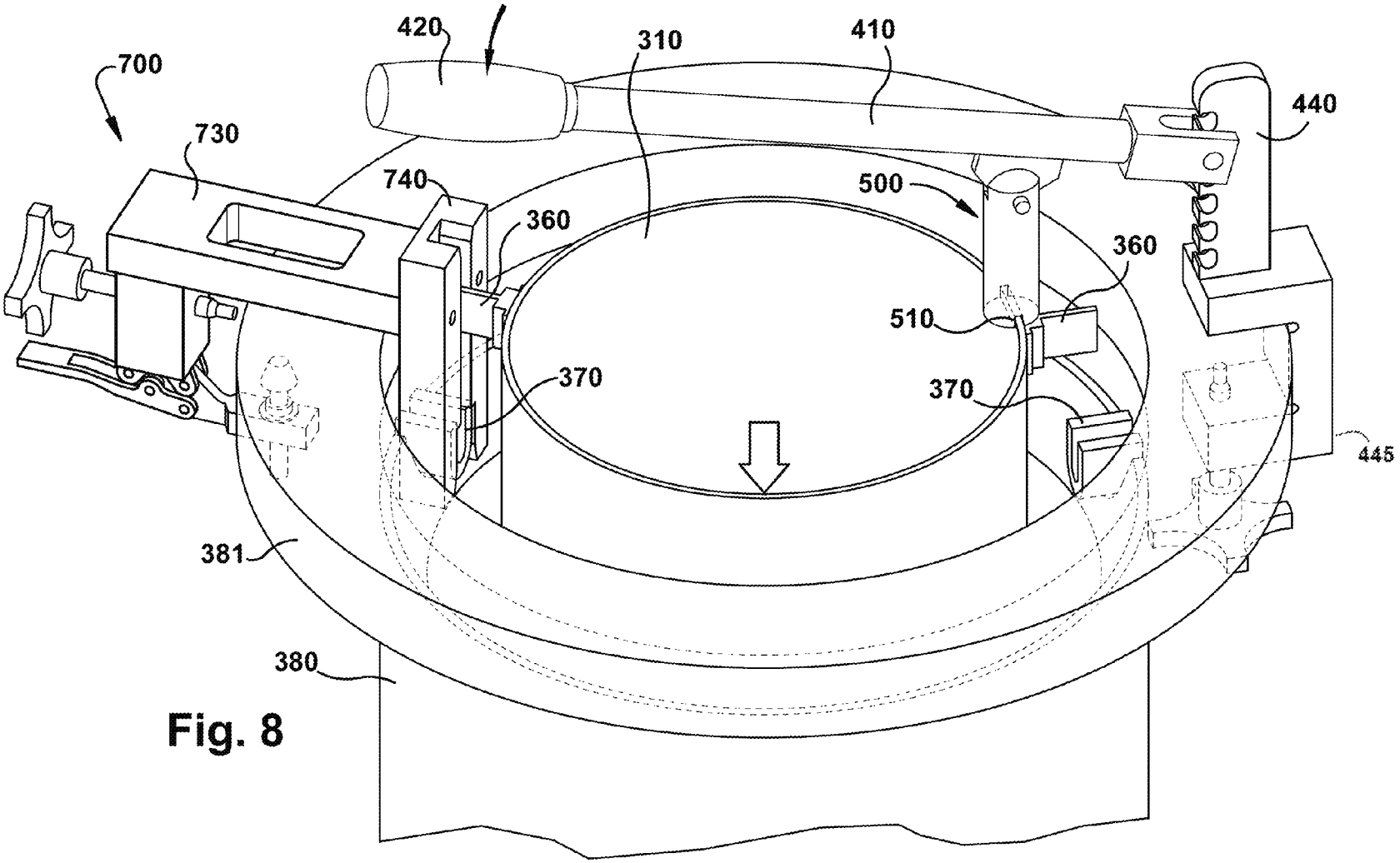
FIG. 8 is a perspective illustration of a combustion case and liner with the handle and clamp of FIG. 4, liner push rod of FIG. 5 and alignment guide of FIG. 7 attached and positioned for an installation procedure, in accordance with an embodiment of the present invention.

FIG. 8 is a perspective illustration of a combustion case 380 and combustion liner 310 with the handle 410 and clamp 445 of FIG. 4, liner push rod 500 of FIG. 5 and alignment guide 700 of FIG. 7 attached and positioned for an installation procedure, in accordance with an embodiment of the present invention. The clamp 445 can be attached to the flange 381 and the pin 435 of handle 410 is inserted into one of the notches on the clamp tower 440. For installation of a combustion liner 310, a liner push rod 500 can be attached to bracket 412. The alignment guide 700 is positioned over a female liner stop 370 and secured to the flange 381. The bottom groove or slot in the liner push rod can be placed over the edge of the combustion liner 310. An operator can then push on the handle 410 by grasping grip 420 and force the liner 310 into position. The leverage provided by the pivot point of pin 435 enables a large amount of force to be applied with a moderate amount of effort by the operator, resulting in a smooth and consistent operation. A further advantage is the elimination of impact loading the liner 310 by means of hammering. For clarity, only two male liner stops 360 are shown. However, it is to be understood that combustion liners may have any suitable number of liner stops.

A method of installing a combustion liner in a combustion case of a turbine, according to one embodiment of the present invention will now be described. The method includes the steps of providing an alignment guide 700 for aligning a stop of the combustion liner with a stop on the combustion case. An attaching step attaches the alignment guide 700 to the combustion case. An inserting step inserts the combustion liner at least partially into the combustion case. An elongated handle assembly (410, 412, 420, 430, 435), liner push rod 500 and a tower clamp assembly (440, 445, 447, 449) are provided and the tower clamp assembly is attached to the combustion case. The liner push rod 500 is attached to the elongated handle assembly, and the elongated handle assembly is attached to the tower clamp assembly. A groove 510 in the liner push rod is positioned over a portion of the combustion liner, and the combustion liner is installed in the combustion case by applying force to the elongated handle assembly.

A method of removing a combustion liner in a combustion case of a turbine, according to one embodiment of the present invention will now be described. The method includes the steps of providing an elongated handle assembly (410, 412, 420, 430, 435), liner pull hook 600 and a tower clamp assembly (440, 445, 447, 449), attaching the tower clamp assembly to the combustion case, attaching the liner pull hook 600 to the elongated handle assembly, and attaching the elongated handle assembly to the tower clamp assembly. The liner pull hook 600 is positioned behind a stop of the combustion liner, and the combustion liner is at least partially removed from the combustion case by applying force to the elongated handle assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An apparatus for installing a combustion liner in a combustion case of a turbine, said apparatus comprising:

a handle having a U-shaped bracket, the U-shaped bracket having a pin disposed therethrough;

a tower clamp configured for attachment to a flange of said combustion case, said tower clamp having a clamp tower portion having a plurality of notches for receiving said pin, and a U-shaped base having an adjustable clamp screw, the adjustable clamp screw and U-shaped base configured to clamp onto the flange, a liner push rod having a bottom slot at one end, the bottom slot configured to fit over a portion of an edge of the combustion liner; and wherein, a second end of the push rod has a top slot arranged orthogonally to the bottom slot, the second end is configured for attachment to a bracket having a through hole, the bracket attached to the handle.

2. The apparatus of claim 1, the handle and tower clamp comprising at least one of the group consisting of:

steel, steel alloys, aluminum and aluminum alloys.

3. The apparatus of claim 1, the liner push rod comprising at least one of the group consisting of:

steel, steel alloys, aluminum and aluminum alloys.

4. The apparatus of claim 1, further comprising:

an alignment guide having a clamp mechanism configured for clamping to said flange and a guide plate having a track configured for accepting at least a portion of a combustion liner stop;

wherein, said track is configured to facilitate alignment of said combustion liner stop and a combustion case stop during installation of said combustion liner.

5. The apparatus of claim 4, the alignment guide comprising at least one of the group consisting of:

steel, steel alloys, aluminum and aluminum alloys.

6. An apparatus for installing a combustion liner in a combustion case of a turbine, the apparatus comprising:

a handle having a U-shaped bracket, the U-shaped bracket having a pin disposed therethrough;

a tower clamp configured for attachment to a flange of the combustion case, the tower clamp having a clamp tower portion having a plurality of notches for receiving the pin, and a U-shaped base having an adjustable clamp screw, the adjustable clamp screw and U-shaped base configured to clamp onto the flange, an alignment guide having a clamp mechanism configured for clamping to the flange and a guide plate having a track configured for accepting at least a portion of a combustion liner stop; and wherein, the track is configured to facilitate alignment of the combustion liner stop and a combustion case stop during installation of the combustion liner.

7. The apparatus of claim 6, the handle and tower clamp comprising at least one of the group consisting of:

steel, steel alloys, aluminum and aluminum alloys.

8. The apparatus of claim 6, the alignment guide comprising at least one of the group consisting of:

steel, steel alloys, aluminum and aluminum alloys.

* * * * *

UNITED STATES PATENT AND TRADEMARK OFFICE

CERTIFICATE OF CORRECTION

PATENT NO. : 8,276,253 B2
APPLICATION NO. : 12/477451
DATED : October 2, 2012
INVENTOR(S) : Herbold et al.

It is certified that error appears in the above-identified patent and that said Letters Patent is hereby corrected as shown below:

In Column 6, Line 36, delete "Tie" and insert -- The --, therefor.

Signed and Sealed this
Twenty-seventh Day of November, 2012

David J. Kappos

David J. Kappos
*Director of the United States Patent and Trademark Office*